United States Patent [19]

Yasika

[11] Patent Number: 4,822,313

[45] Date of Patent: Apr. 18, 1989

[54] TOY ASSEMBLY DEVICE

[76] Inventor: Douglas P. Yasika, 12 Colby Rd., Danville, N.H. 03819

[21] Appl. No.: 12,553

[22] Filed: Feb. 9, 1987

[51] Int. Cl.[4] ..... A63H 33/06

[52] U.S. Cl. ..... 446/69; 446/85; 446/124; 428/542.2

[58] Field of Search ..... 446/117, 85, 107, 109, 446/120, 124, 125, 486, 491, 69, 108; 428/52, 99, 101, 542.2; D 21/108

[56] References Cited

U.S. PATENT DOCUMENTS

| | | | |
|---|---|---|---|
| 2,791,868 | 5/1957 | Viken | 446/107 |
| 3,728,201 | 4/1973 | Stroehmer | 446/85 X |
| 3,895,456 | 7/1975 | Fabre | 446/116 X |
| 4,170,083 | 10/1979 | Freelander et al. | 446/107 X |

FOREIGN PATENT DOCUMENTS

| | | | |
|---|---|---|---|
| 949154 | 2/1964 | United Kingdom | 446/97 |

*Primary Examiner*—Mickey Yu

*Attorney, Agent, or Firm*—Edward A. Gordon

[57] ABSTRACT

A toy assembly device and toy assemblages formed therefrom is disclosed. The toy assembly device includes a substantially flat member formed of a resilient flexible material and having a peripheral edge. The flat member is sufficiently folded upon itself to form upper and lower opposing surfaces having corresponding upper and lower opposing peripheral edges extending from the common fold area. The opposing upper and lower surfaces are attached together at a point adjacent the peripheral edges whereby the opposing surfaces and edges define an opening therebetween extending the length of the fold area and terminating in a pair of lateral openings. The lateral openings taper from the fold area to an area of contact between the opposing upper and lower surfaces adjacent the point of attachment. The peripheral edges forming the lateral openings are sufficiently resilient to each releasably hold the end of a second toy device inserted therein to thereby sequentially form as assemblage of the toy devices. A multiplicity of the toy assembly devices of the present invention can be interconnected to form an assemblage of various designs, shapes and sequences. Additionally various indicia such as letters, numbers and the like are disposed upon the surfaces of the toy devices to provide both educational and entertainment features.

17 Claims, 4 Drawing Sheets

TOY ASSEMBLY DEVICE

FIELD OF THE INVENTION

The present invention relates generally to the field of toys and more particularly to a novel toy device constructed with interlocking areas for interconnecting with other toy devices to form an assemblage of the devices having entertainment and educational features.

BACKGROUND OF THE INVENTION

Various prior art toy devices providing entertainment and/or educational features are manifold. For example, the building blocks having the alphabet disposed upon the individual blocks are well known as are the construction devices where pieces are assembled to form a person, article, vehicle and the like. While such prior art devices are useful in the areas intended, they are limited in providing various designs, shapes and educational features. With respect to prior art toys which disclose assembly devices, U.S. Pat. No. 3,790,175 to Ragnow of Feb. 5, 1974, there is disclosed a puzzle ball in which resilient disks are fitted together to form a ball. U.S. Pat. No. 3,728,201 to Stroehmer of Apr. 17, 1973 discloses an ornamental device formed from a plurality of flat disk members which are attached to other members in such a way as to form a icosahedron.

While such prior art deviced provide improvement in the areas intended, there still exists a great need for a toy assembly device which is easily assembled and disassembled while providing educational and entertainment concepts.

Accordingly a principal desirable object of the present invention is to provide a novel toy assembly device constructed with interlocking areas for interlocking with other toy devices to form an assemblage of the devices.

Another desirable object of the present invention is to provide a toy device which can be releasably interlocked or connected with a multiplicity of other such toy devices to form various designs, shapes and sequences.

Another desirable object of the present invention is to provide a toy assembly device which can be easily assembled and disassembled by anyone, particularly a child.

A still further desirable object of the present invention is to provide a toy assembly device of the above desirable objects wherein the outer surface of the individual devices presents a thematically-illustrated story in sequence as the multiplicity of the toy devices are assembled.

Another desirable object of the present invention is to provide a toy device having an outer surface with various indicia thereon relating to educational and/or intelligence concepts.

A still further desirable object of the present invention is to provide a toy assembly device which is simple in construction and relatively inexpensive to manufacture.

Other desirable objects and advantages of the present invention will in part appear hereinafter and will in part become apparent after consideration of the specification with reference to the accompanying drawings.

SUMMARY OF THE INVENTION

In accordance with the present invention the toy assembly device comprises a unitary body member preferably formed of a substantially flat, resilient flexible material and having upper and lower surface members defined by a peripheral edge. The unitary body member is sufficiently folded upon itself to form upper and lower inner opposing surface members having corresponding upper and lower opposing peripheral edges extending from the common fold area. The opposing upper and lower surface members are attached together at a point adjacent the peripheral edges whereby the opposing inner surface members and edges define an opening therebetween extending the length of the fold area and terminating in a pair of lateral openings. The lateral openings taper from the fold area to an area of contact between the opposing upper and lower surfaces adjacent the point of attachment. The peripheral edges forming the lateral openings are sufficiently resilient to each releasably hold the end of a second toy assembly device inserted therein to thereby form an assemblage of the toy assembly devices. A multiplicity of the toy assembly devices of the present invention can be interconnected to form an assemblage of various designs, shapes and sequences. Additionally various indicia such as letters, numerals and the like are disposed upon the surfaces of the toy devices to provide both educational and entertainment features. In one embodiment of the invention a plurality of the toy devices are provided with indicia on one surface presenting a thematically-illustrated story in sequence as the toy devices are assembled and on the other surface other indicia indicating the correct sequence of assemblage.

BRIEF DESCRIPTION OF THE DRAWINGS

For a fuller understanding of the nature and desired objects of the invention, reference should be had to the following detailed description taken in connection with the accompanying drawings wherein like reference characters denote corresponding parts throughout the several views and wherein.

DETAILED DESCRIPTION OF PREFERRED EMBODIMENTS

Figure 1:
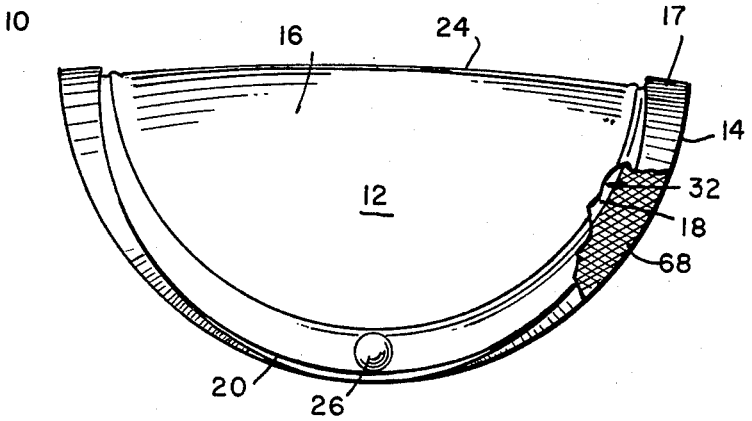
FIG. 1 is a top perspective view of a toy assembly device in accordance with the present invention.
Figure 2:
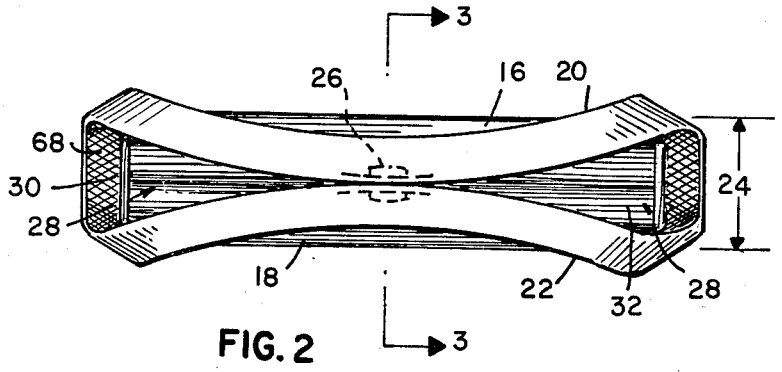
FIG. 2 is a front elevation view of the device of FIG. 1.
Figure 3:
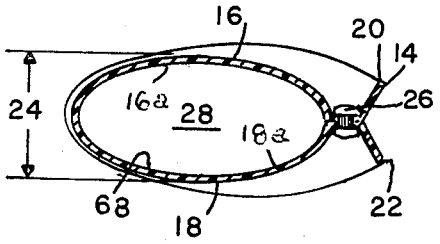
FIG. 3 is a sectional view of the device of FIG. 2 taken along the line 3—3.

Referring now to the drawings and more particularly to FIGS. 1–3 there is shown generally at 10 a toy assembly device in accordance with the present invention which includes a unitary body member 12 preferably having a substantially flat configuration and a peripheral edge 14. The unitary body member 12 is sufficiently folded upon itself to form an upper surface member 16 and an opposing lower surface member 18. The upper and lower surface members 16 and 18 have corresponding upper and lower inner opposing surface members **16*a* and 18*a* and opposing peripheral edge portions 20 and 22 respectively. The upper and lower surface members 16 and 18 and their associated peripheral edges 20 and 22 extend outwardly from a common fold area 24 which is shown by the dotted lines of FIGS. 2 and 3. The body member 12 is formed of a suitable flexible and resilient material such as plastic. One suitable plastic material is polyvinyl chloride which can be extruded in sheet form of sufficient thickness to provide the desired flexibility and resilience to provide interlocking engagement as described hereinafter. It can be appreciated however that body member 12** can be formed of other materials such as paper, fabrics, metals and combinations thereof which provide suitable resilient and flexible qualities.

Figure 9:
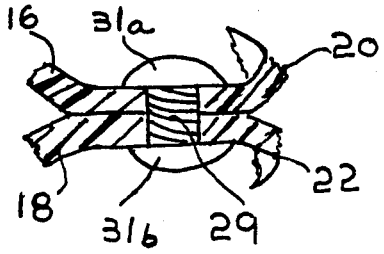
FIG. 9 is a fragmentary cross-sectional view of a spring member for attaching the upper and lower surface members together.

The upper and lower surface members 16 and 18 are attached together at approximately the longitudinal midpoints at or adjacent to the peripheral edges 20 and 22. Suitable means for attaching the upper and lower surface members 16 and 18 is shown as a grommet element 26 which extends through the surface members 16 and 18. Other suitable means for attaching the surface members 16 and 18 together can be employed such as a heat seal where plastic material is employed, adhesives or snaps as is well known. Still other suitable attaching means can be, for example, a suitable spring member 29 (as shown in FIG. 9) having end members **31*a* and 31*b* respectively attached to the upper and lower surface members 16 and 18 which urges the surface members together. The main requirement of the attaching means is that it serves to bring the upper and lower surface members into juxtaposition along the forward peripheral edge while minimizing the area of permanent contact between the upper and lower surface members 16 and 18, formed by the attaching or securing means. The opposing surface members 16 and 18 define an open area 28 therebetween which extends the length of the fold area 24 and terminates in two lateral openings 30 and 32. The open area 28 and lateral openings 30 and 32 taper from the fold area 24 to the area of contact of the opposing upper and lower surface members adjacent the attaching means 26. In this manner the peripheral edges 20 and 22 extending from the attaching means 26 to the fold area 24 define the lateral openings 30 and 32. The peripheral edges 20 and 22 are sufficiently resilient and flexible whereby the openings 30 and 32 are adapted to releasably hold the end of another toy assembly device. In a preferred embodiment a raised edge or rim member 17 is provided on the outer surface of body member 12 adjacent the peripheral edge 14 about the lateral openings 30 and 32. The rim member 17 serves to increase the resiliency of the peripheral edges 20 and 22 and the holding feature of the openings 30 and 32** formed therefrom as further described hereinafter.

Figure 4:
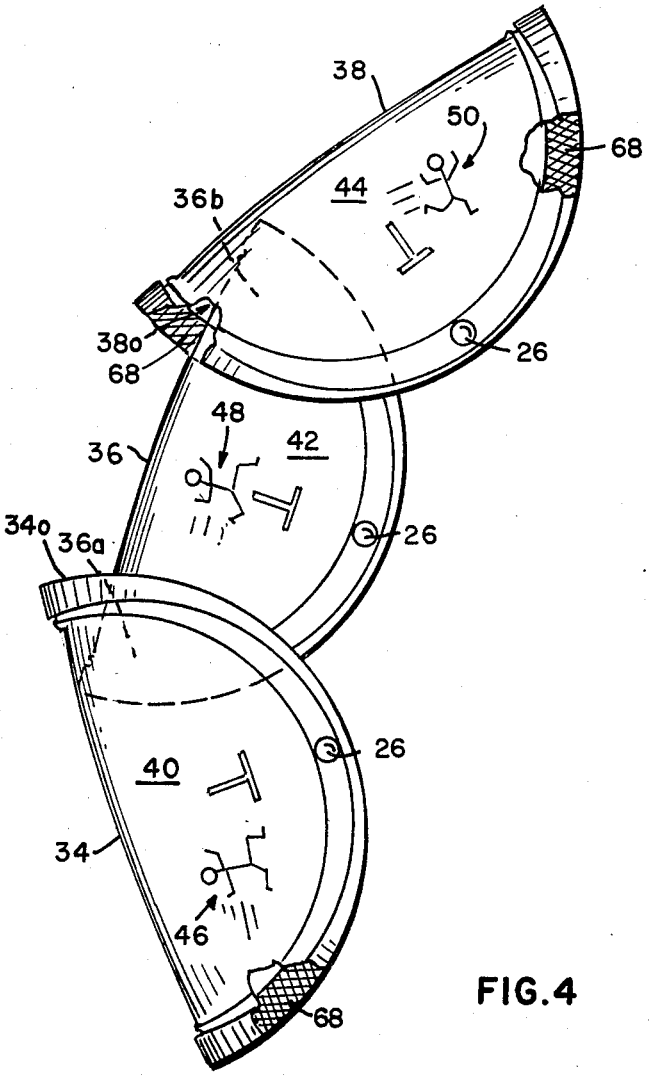
FIG. 4 is a top plan view of an assemblage of three toy assembly devices of FIG. 1 illustrating the lateral interconnecting of the devices and showing a pictorial sequence on the upper surfaces.

Referring now to FIG. 4, there is shown an assemblage of three toy assembly devices 34, 36 and 38 of the type described with respect to FIG. 1 formed of a flexible and resilient plastic material. To form an assemblage of two or more toy devices in accordance with the present invention (reference still being made to FIG. 4) the end **36*a* (shown by dotted line) of toy device 36 is compressed by the player's fingers and inserted into the lateral opening 34*o* of the toy assembly device 34 and released where it is releasably held by frictional engagement between contacting surfaces and edges of each of the toy assembly devices. In a similar manner the end 36*b* of toy assembly device 36 is compressed and inserted into the lateral opening 38*o* to complete the assemblage of the three toy assembly devices 34, 36 and 38. Still referring to FIG. 4 it can be seen that, as the assembly takes place sequentially, the outer surfaces 40, 42 and 44 have printed or otherwise disposed thereon scenes 46, 48 and 50. As illustrated, the scenes 46, 48 and 50** convey a story or action that is taking place when the toy assembly devices are placed in that sequential order. It is apparent then that various themes or stories can be presented which present a challenge to the player to assemble in the proper sequential order. In accordance with the present invention the correct sequential order can, for example, be determined by providing numerals (not shown) on the reverse side which chronologically disclose the correct sequence. Similarly the toy assembly devices can have disposed thereon pictures, lithographic scenes or the like to amuse the player during assembly of the toy devices.

Figure 5:
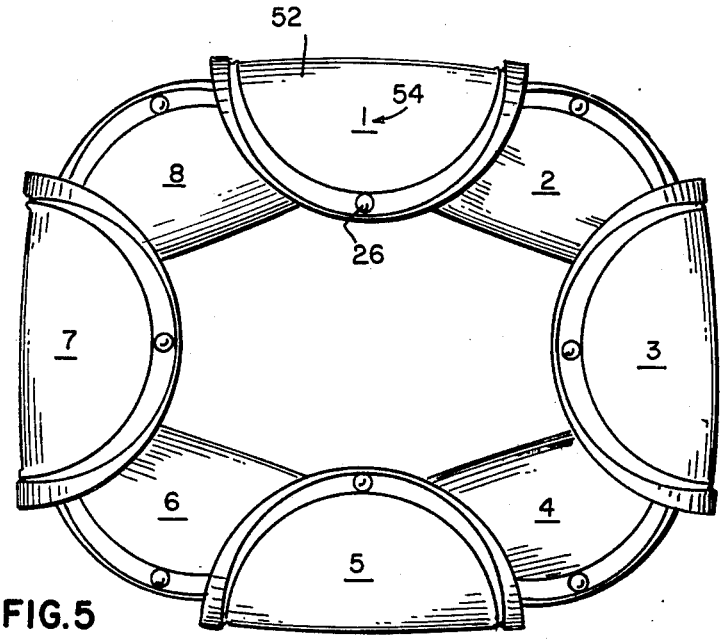
FIG. 5 is a perspective view of a design assemblage of a plurality of the toy assembly devices of FIG. 1 with indicia of a numerical sequence thereon.

Referring now to FIG. 5 there is illustrated another possible design assemblage of a plurality of toy assembly devices 52 which have different numerical indicia 54 on the upper surface. As shown the toy assembly devices 52 are assembled with the numerical indicia sequentially arranged clockwise 1–8.

Figure 6:
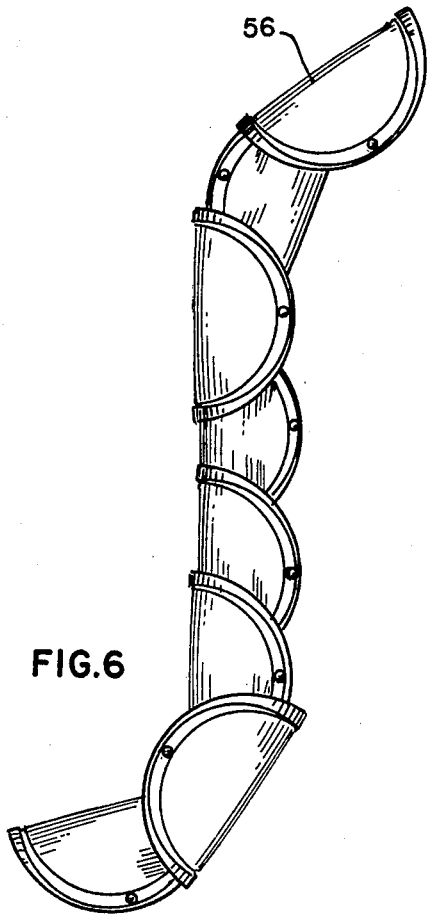
FIG. 6 is a perspective view of an alternate assemblage design of the toy assembly devices of the present invention.

Referring now to FIG. 6 there is illustrated a still further possible assemblage of a multiplicity of toy assembly devices 56 in accordance with the present invention.

Figure 7:
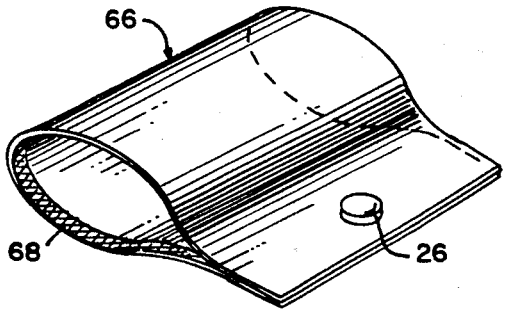
FIG. 7 is a top plan view of a modified embodiment of the toy assembly device in accordance with the present invention.
Figure 8:
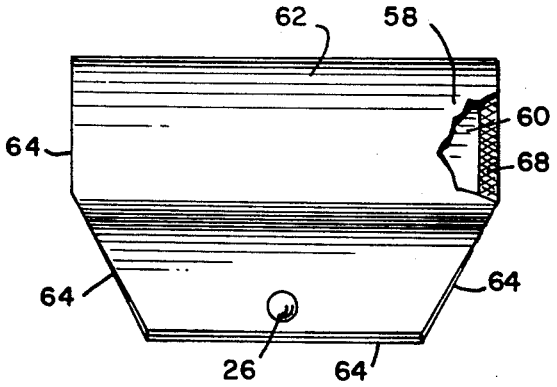
FIG. 8 is a plan view of another modified embodiment of the toy assembly device in accordance with the invention.

While the general configuration of the toy assembly device of FIGS. 1–3 can be described as having a "half moon" or "turnover" configuration, other configurations can be employed. For example, FIGS. 7 and 8 illustrate modified embodiments of the configuration of the toy assembly device of the present invention. In FIG. 7 the toy assembly device 66 is provided with a generally square configuration. As shown in FIG. 8 the upper and lower surface members 58 and 60 of toy device 62 are provided with a peripheral edge having a plurality of corresponding straight line segments 64.

In accordance with the present invention, the toy assembly devices may be distinguished by various colors, or where sequencing indicia is desired by a color-code on one side to provide proper sequencing of, for example, a theme depicted on the other side. One color-code, for example, can be as follows: toy devices numbered 1–5 are given increasing shades of red from light to dark and devices numbered 6–10 given increasing shades of blue from light to dark to thereby determine the starting and ending point in each color series.

In a modified embodiment of the invention, referring again to FIG. 1, the inner surfaces of upper and lower opposing peripheral edges 20 and 26 are provided with an area having high frictional characteristics. Such frictional characteristics can be provided by, for example, a raised roughen or knurled member 68 conveniently formed of the device material. Increased frictional characteristics can also be provided by attaching various materials such as soft rubber materials for example. Such frictional areas 68 cooperate with the flexibility and resiliency of the material forming the lateral openings 30 and 32 to enhance the interlocking function of the lateral openings.

Additionally it has been determined that one suitable size for the toy assembly device of the present invention is one having a length of approximately 5 inches long (as measured along the fold area 24) and a width of approximately 2.5 inches (as measured from the fold area 24 to the peripheral edge adjacent the attaching means 26). A toy assembly device having such a size can be readily manipulated by all persons and particularly by a small child.

While the invention has been described with respect to preferred embodiments it will be apparent to those skilled in the art that changes and modifications may be made without departing from the scope of the invention herein involved in its broader aspects. Accordingly, it is intended that all matter contained in the above description, or shown in the accompanying drawing shall be interpreted as illustrative and not in a limiting sense.

What is claimed is:

1. A toy assembly device comprising:

a substantially flat member formed of a resilient flexible material having upper and lower surfaces and a peripheral edge;

said flat member being sufficiently folded upon itself whereby said lower surface forms upper and lower inner opposing surface members having corresponding upper and lower opposing peripheral edges extending from a common fold area; and means for attaching said opposing upper and lower surfaces together at a point adjacent the peripheral edges whereby said opposing surface members and edges define an opening therebetween extending the length of said fold area and terminating in a pair of lateral openings;

said lateral openings tapering from said fold area to an area of contact of said opposing upper and lower surface members adjacent said attaching means;

the peripheral edges forming said lateral openings being sufficiently resilient and means disposed adjacent said opposing peripheral edges for releasably holding the end of another toy assembly device inserted in said openings to thereby form an assemblage thereof.

2. A toy assembly device comprising:

a substantially flat member formed of a resilient flexible material having upper and lower surface members defined by a peripheral edge;

a rim member disposed about said upper surface adjacent said peripheral edge;

said flat member being sufficiently folded upon itself whereby said lower surface forms upper and lower inner opposing surface members having corresponding upper and lower opposing peripheral edges extending from a common fold area; and means for attaching said opposing upper and lower surface members together at a point adjacent the peripheral edges whereby said opposing surface members and edges define an opening therebetween extending the length of said fold area and terminating in a pair of lateral openings;

said lateral openings tapering from said fold area to an area of contact of said opposing upper and lower surface members adjacent said attaching means;

the peripheral edges forming said lateral openings being sufficiently resilient to releasably hold the end of another toy assembly device inserted in said openings to thereby form an assemblage thereof.

3. The toy assembly device of claim 2 further including means disposed upon at least one of said upper and lower surface members representing alphabetical characters.

4. The toy assembly device of claim 2 further including means disposed upon at least one of said upper and lower surface members representing numerical characters.

5. The toy assembly device of claim 2 further including means disposed upon at least one of said upper and lower surface members representing pictorial scenes.

6. The toy assembly device of claim 2 further including frictional means disposed upon at least a portion of the inner opposing surface members adjacent the peripheral edges thereof.

7. The toy assembly device of claim 2 wherein said attaching means comprises a spring means urging said upper and lower surface members together.

8. An article of manufacture forming a toy assemblage device comprising:

a multiplicity of toy assembly devices, each toy assembly device comprising:

a unitary body member formed of a resilient flexible material having upper and lower surface members defined by a peripheral edge;

a rim member disposed about said upper surface member adjacent said peripheral edge;

said unitary body member being sufficiently folded upon itself whereby said lower surface member forms upper and lower inner opposing surface members having corresponding upper and lower opposing peripheral edges extending from a common fold area; and means for attaching said opposing upper and lower surface members together at a point adjacent the peripheral edges whereby said opposing surface members and edges define an opening therebetween extending the length of said fold area and terminating in a pair of lateral openings;

said lateral openings tapering from said fold area to an area of contact of said opposing upper and lower surface members adjacent said attaching means;

the peripheral edges forming said lateral openings being sufficiently resilient to releasably hold the end of another toy assembly device inserted in said openings to form said toy assemblage device.

9. The article of manufacture of claim 8 further including printed thematic stories in the form of pictures disposed in a sequential manner upon the outer surfaces of said toy assembly devices.

10. The article of manufacture of claim 8 further including printed matter in the form of pictures disposed upon the outer surfaces of each said toy assembly devices.

11. The article of manufacture of claim 8 wherein said toy assembly devices are color coded.

12. The article of manufacture of claim 8 further including means disposed upon the outer surfaces of said toy assembly devices representing alphabetical characters.

13. The article of manufacture of claim 8 further including means disposed upon the outer surfaces of said toy assembly devices representing numerical characters.

14. The article of manufacture of claim 8 further including frictional means disposed upon at least a portion of the inner opposing surface members adjacent the peripheral edges thereof.

15. An article of manufacture forming a toy assemblage device comprising:

a multiplicity of toy assembly devices, each toy assembly device comprising:

a unitary body member formed of a resilient flexible material having upper and lower surface members defined by a peripheral edge;

a rim member disposed about said upper surface member adjacent said peripheral edge;

said unitary body member being sufficiently folded upon itself whereby said lower surface member forms upper and lower opposing surface members having corresponding upper and lower opposing peripheral edges extending from a common fold area;

means for attaching said opposing upper and lower surface members together at a point adjacent the peripheral edges whereby said opposing surface members and edges define an opening therebetween extending the length of said fold area and terminating in a pair of lateral openings; and frictional means disposed upon at least a portion of the inner surfaces of said lateral openings adjacent the peripheral edges thereof;

said lateral openings tapering from said fold area to an area of contact of said opposing upper and lower surface members adjacent said attaching means;

the peripheral edges forming said lateral openings being sufficiently resilient to releasably hold the end of another toy assembly device inserted therein to form said toy assemblage device.

16. The article of manufacture of claim 15 wherein said frictional means comprises a knurled edge.

17. An article of manufacture forming a toy assemblage device comprising:

a multiplicity of toy assembly devices, each toy assembly device comprising:

a unitary body member formed of a resilient flexible material having upper and lower surface members defined by a peripheral edge;

a rim member disposed about said upper surface member adjacent said peripheral edge;

said unitary body member being sufficiently folded upon itself whereby said lower surface member forms upper and lower opposing surface members having corresponding upper and lower opposing peripheral edges extending from a common fold area;

means for attaching said opposing upper and lower surface members together at a point adjacent the peripheral edges whereby said opposing surface members and edges define an opening therebetween extending the length of said fold area and terminating in a pair of lateral openings; and a knurled area disposed upon at least a portion of the inner surfaces of said upper and lower surface members adjacent the peripheral edges forming said lateral openings;

said lateral openings tapering from said fold area to an area of contact of said opposing upper and lower surface members adjacent said attaching means;

the peripheral edges forming said lateral openings being sufficiently resilient to coact with said knurled area to releasably hold the end of another toy assembly device inserted in said openings to thereby form said toy assemblage device.

* * * * *